United States Patent [19]

Nogi et al.

[11] Patent Number: 4,573,674

[45] Date of Patent: Mar. 4, 1986

[54] DEVICE FOR DELIVERY OF PAPER SHEETS FOR AN APPARATUS FOR COUNTING THE NUMBER OF PAPER SHEETS

[75] Inventors: Hiroyoshi Nogi, Tokyo; Shigeru Tanaka, Kashiwa, both of Japan

[73] Assignee: Musashi Engineering Kabushiki Kaisha, Tokyo, Japan

[21] Appl. No.: 566,200

[22] Filed: Dec. 28, 1983

[30] Foreign Application Priority Data

Jan. 10, 1983 [JP] Japan ..... 58-749[U]

[51] Int. Cl.[4] ..... B65H 3/06

[52] U.S. Cl. ..... 271/118; 271/119

[58] Field of Search ..... 271/109, 117, 118, 119, 271/120, 114, 116, 10, 4, 122, 37

[56] References Cited

U.S. PATENT DOCUMENTS

| | | | |
|---|---|---|---|
| 3,593,988 | 7/1971 | Collins | 271/119 |
| 4,443,006 | 4/1984 | Hasegawa | 271/10 |
| 4,474,365 | 10/1984 | DiBlasio | 271/116 |

*Primary Examiner*—Bruce H. Stoner, Jr.
*Assistant Examiner*—John A. Carroll
*Attorney, Agent, or Firm*—Brooks, Haidt, Haffner & Delahunty

[57] ABSTRACT

Apparatus for counting the number of paper sheets has a pair of feed-out, or delivery, auxiliary rolls rotatably mounted at the bottom of a hopper for advancing paper sheets stacked in the hopper towards a payout rolls mounted adjacent the hopper outlet. Each auxiliary delivery roll has a frictional surface forming a portion of the roll periphery and a relatively slippery surface forming the remainder of the roll periphery. The frictional surface has a recessed peripheral zone, all points of which are spaced from the center of the roll by a distance less than that by which the periphery of a slippery surface, forming the remaining portion of the roll periphery, is spaced from the center of the roll. The paper sheets stacked in the hopper are moved vertically by the auxiliary rolls and advanced towards the payout roll with a larger force of friction by being contacted over a wider area by the frictional surface.

5 Claims, 10 Drawing Figures

DEVICE FOR DELIVERY OF PAPER SHEETS FOR AN APPARATUS FOR COUNTING THE NUMBER OF PAPER SHEETS

BACKGROUND OF THE INVENTION

This invention relates to a paper sheet number counting apparatus of the type in which the sheets stored in a stacked state in a hopper are delivered towards a stacker by means of a payout roll. More particularly, it relates to an improvement in an auxiliary roll employed in such apparatus and by means of which the sheets are delivered towards the payout roll.

FIG. 1 shows a typical setup of the counting apparatus of the above type, in which an auxiliary delivery roll 3 consisting of an offset roll is rotatably mounted on the bottom 2 of a hopper unit 1, and a large diameter payout roll 6 is mounted at the outlet of the hopper unit 1 in a facing relation to a guide roll 4 and a separating roll 5. A pinch roll 7 is mounted adjacent to the payout roll 6 at the downstream side relative to the rotational direction of the payout roll 6, whereas extracting rolls 9 and a stacker disk 10 are mounted at the outlet side of the guide plates 8, 8' mounted, in turn, close to the peripheral surface of the payout roll 6.

In this known device, the auxiliary delivery roll 3 of the hopper unit 1 used for transport of the paper sheets is designed as offset roll, and the roll 3 is contacted with the paper sheet by a frictional covering, such as rubber covering, provided on a portion of the peripheral surface of the roll. However, the circumferential extent with which the covering contacts the paper sheet is so narrow that an insufficient friction is actually transmitted from the covering to the paper sheet. For instance, when the paper sheet is a banknote fresh from the press, and thus showing a smooth surface and considerable toughness, smooth and stable delivery of the paper sheets at an enhanced speed may become unfeasible thus inevitably lowering the operating speed of the apparatus.

SUMMARY OF THE INVENTION

It is an object of the present invention to provide means for effectively obviating the aforementioned drawback of the prior-art apparatus. Thus, the frictional surface of the feed-out auxiliary roll has a recessed or an interrupted peripheral zone any point of which is spaced a distance less than the distance by which any point of the remaining peripheral portion is spaced from the center of the roll. This recessed portion acts for vertically moving the sheets in the internal space of the hopper and supplying them to a narrow space between the separating and payout rolls while allowing a frictional contact over a wider area between the sheets and the frictional surface.

DESCRIPTION OF THE PREFERRED EMBODIMENTS

Referring to the accompanying drawings, there is illustrated an apparatus for delivery of paper sheets according to the present invention.

Figure 2:
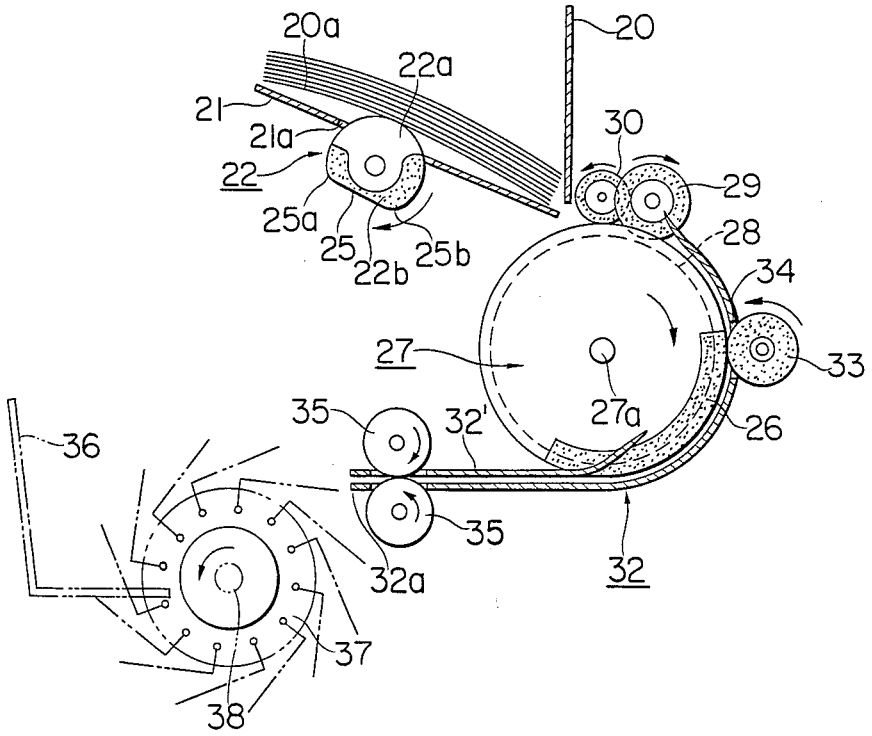
FIG. 2 is a schematic side view showing the apparatus for counting the number of paper sheets provided with a pair of paper sheet feed-out auxiliary rolls according to the present invention.
Figure 5:
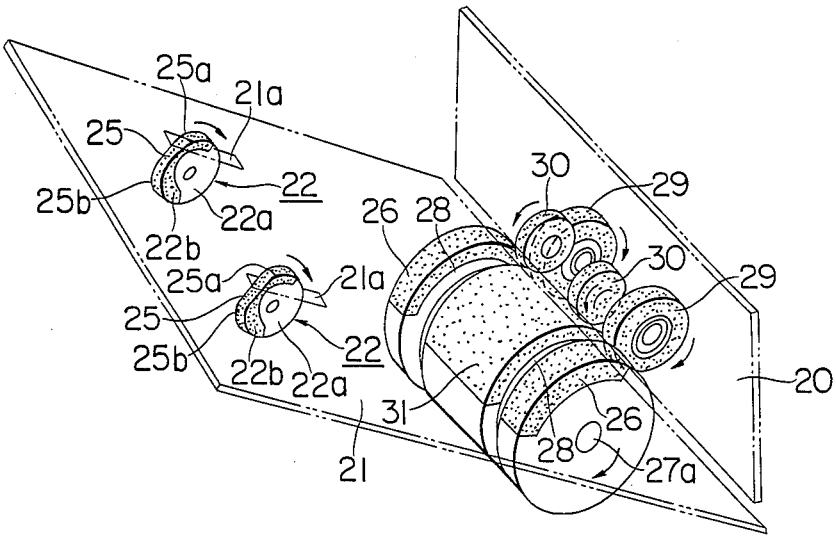
FIG. 5 is a perspective view showing essential parts of the apparatus for counting the number of paper sheets shown in FIG. 2.

In FIGS. 2 and 5, the numeral 20 designates a generally box-shaped hopper unit containing stacked paper sheets 20*a*. The hopper unit 20 has a bottom 21 in which there is rotatably mounted a pair of disk-shaped delivery, auxiliary rolls 22 by being journaled on a main body, not shown. These delivery, auxiliary rolls 22 are so mounted that their peripheries project through a pair of through-holes 21*a* in the bottom 21 and beyond the upper surface of the bottom 21.

Figure 3:
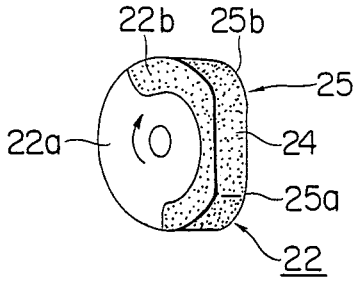
FIG. 3 is a perspective view showing the feed-out auxiliary roll.
Figure 4:
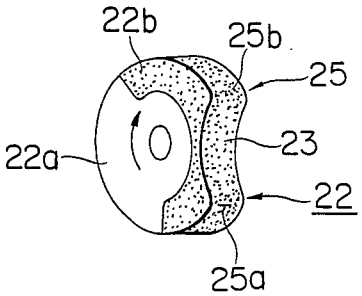
FIG. 4 is a perspective view showing a modified embodiment of the feed-out auxiliary roll shown in FIG. 3.

The peripheral surface of each delivery, auxiliary roll 22 is made up of a first or slippery surface 22*a* and a second or frictional surface 22*b* made of rubber or the like material having a coefficient of friction larger than that of the first surface 22*a*. This frictional surface 22*b* has a recessed zone 25 consisting of a flat surface 24 or a concave surface 23 (FIGS. 3 and 4). Each point on the surface 24 or 25 is spaced from the center of the disk by a distance less than the distance by which each point on the slippery surface 22*a* is spaced from the center or axis of the disk. The corners or points of transition 25*a*, 25*b* from the circular periphery to the straight or concave periphery are rounded or chamfered as shown. The radius of curvature of the upstream side rounded corner 25*a* of the recessed zone 25, looking in the rotational direction of the roll, is selected to be less than that of the other rounded corner 25*b* (see FIGS. 3 and 4). These radii of curvature are less than the radius of the auxiliary roll 22. The peripheral length of the frictional surface as measured from the upstream end of the frictional surface 22*b*, looking in the rotational direction of the roll 22, to the corner 25*a* is less than the peripheral length of the frictional surface as measured from the downstream end of the frictional surface to the corner 25*b*. To the outlet side of the hopper unit 20, there is a payout roll 27 mounted on a shaft 27*a* carried by the main body of the counting apparatus, not shown, so that the roll 27 may be rotated about shaft 27*a* in the direction of the arrow shown in FIG. 2. A pair of payout frictional sections 26 and a pair of circumferential grooves 28 are formed on the peripheral surface of the roll 27 (FIG. 5). Facing these grooves 28 are a pair of separating rolls 29 rotatably mounted on the main body of the apparatus, not shown. A pair of guide rolls 30 are mounted on the main body in the neighborhood of the separating rolls 29 and may be rotated with a small gap between their peripheral surfaces and a central surface 31 of the payout roll 27.

In the neighborhood of the outer periphery of the payout roll 27, there are mounted a pair of substantially J-shaped guide plates 32, 32' (FIG. 2). At the outer side of the curved portion of the guide plate 32, there is a pinch roll 33 rotatably mounted on the main body of the apparatus, not shown. A portion of the outer periphery of the pinch roll 33 passes through an opening 34 in the curved portion of the guide plate 32 and is disposed at a small distance from the outer periphery of the payout roll 27. A pair of extracting rolls 35 are mounted at an outlet 32*a* of the guide plates 32, 32' for rotation in the direction of the arrow shown in FIG. 2 on the main body of the apparatus, not shown. A disk or wheel 37, provided with a number of vanes for placing the sheets 20*a* extracted by the rolls 35 in the stacker 36, is also mounted on the main body by a shaft 38 for rotation in the arrow direction shown in FIG. 2.

Figure 6:
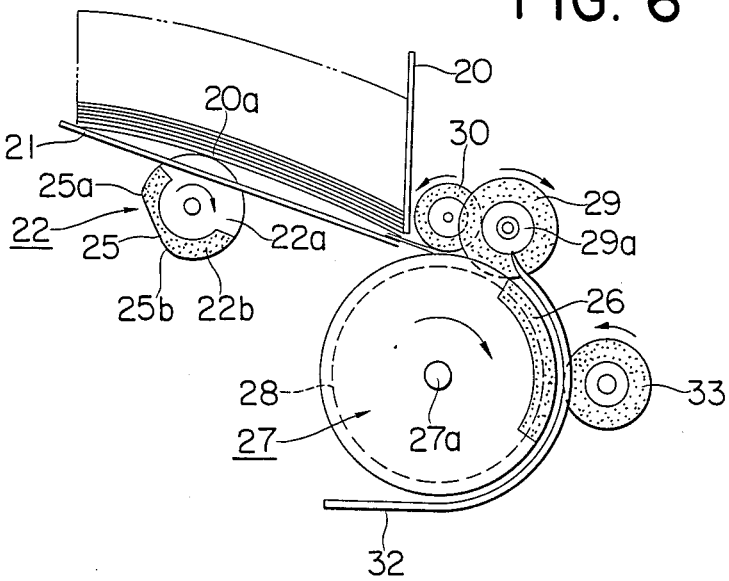
FIGS. 6 to 9 are side views for explaining the operation of the apparatus for counting the number of paper sheets according to the present invention.
Figure 8:
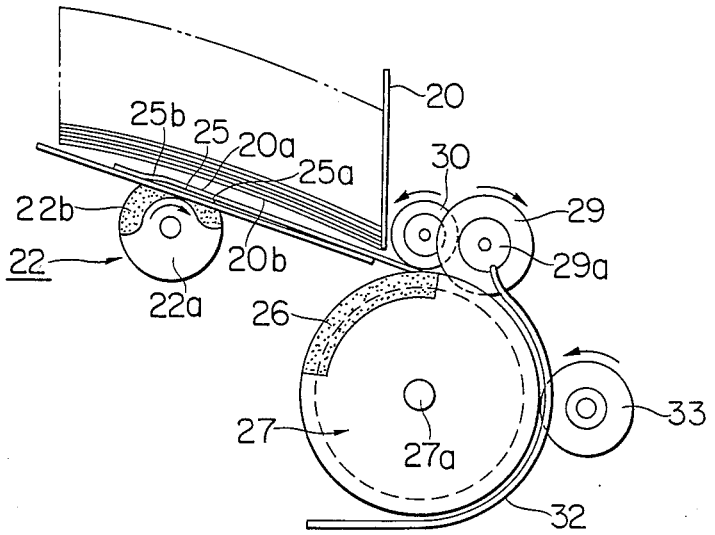
Figure 9:
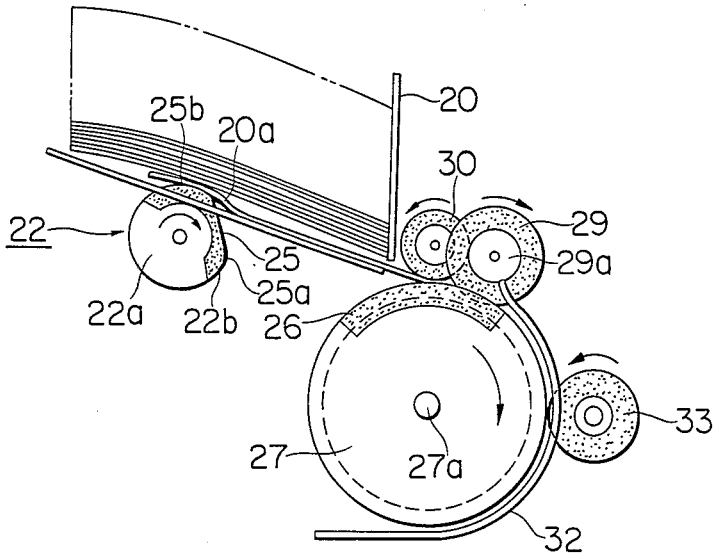

The paper sheet delivery device so far shown and described operates as follows. When a driving electric motor, not shown, is started with the various parts in the state shown in FIG. 6, the delivery, auxiliary rolls 22 and the payout roll 27 are driven in synchronized rotation in a known manner. When the frictional surface 22*b* of each delivery, auxiliary roll 22 contacts a paper sheet 20*a*, the latter is separated from a paper sheet 20*b* disposed thereabove on the basis of the difference in friction. As the roll 22 is rotated further, the paper sheet 20*a* is brought from the state shown in FIG. 8 to the state shown in FIG. 9, so that the sheet 20*a* is delivered to the gap between the payout roll 27 and the separating rolls 29. These separating rolls 29 are associated with an overrunning clutch 29*a* in such a manner that the rolls can be rotated freely in the direction of the arrow in the drawing, but are locked against rotation in the opposite direction. Hence, the rolls 29 may be rotated at all times only in the arrow direction. If two or more sheets 20*a*, 20*b* are delivered to these rolls 27, 29, only the paper sheet 20*a* contacting the payout roll 27 is separated and paid out, because the friction acting between the separating rolls 29 and the paper sheet 20*b* and the friction acting between the payout roll 27 and the paper sheet 20*b* are larger than the friction acting between the paper sheets 20*a*, 20*b*. The paper sheet 20*a* sandwiched between the payout frictional sections 26 of the payout roll 27 and the pinch roll 33 is guided and transferred along the profile of the guide plate, extracted by rolls 35 and placed in a stacked form in a stacker 36 by means of the disk 37, in a known manner.

Figure 1:
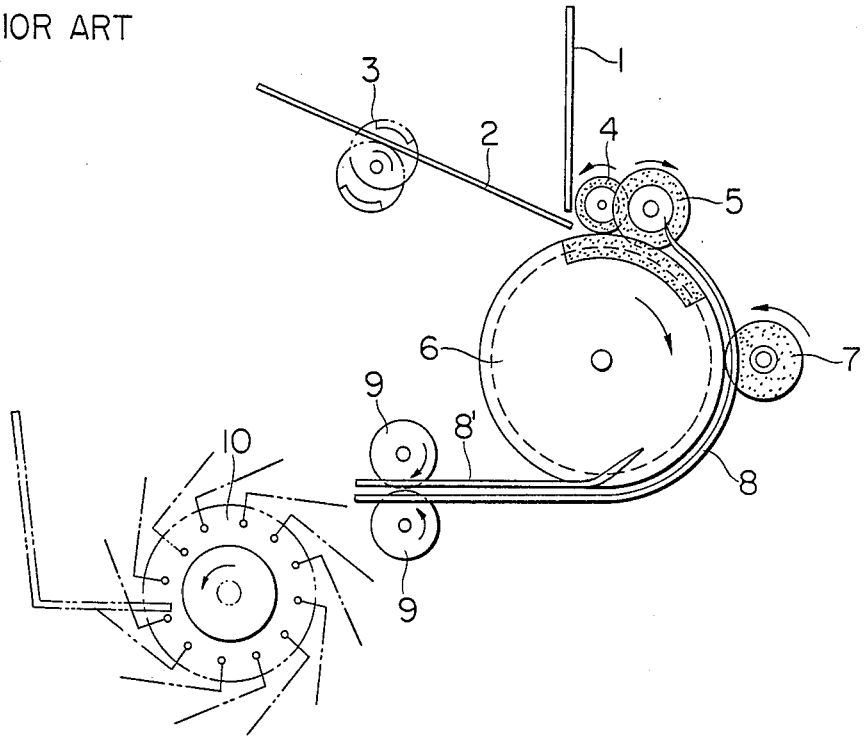
FIG. 1 PRIOR ART
FIG. 1 is a schematic side view showing the apparatus of the prior art for counting the number of paper sheets.
Figure 7:
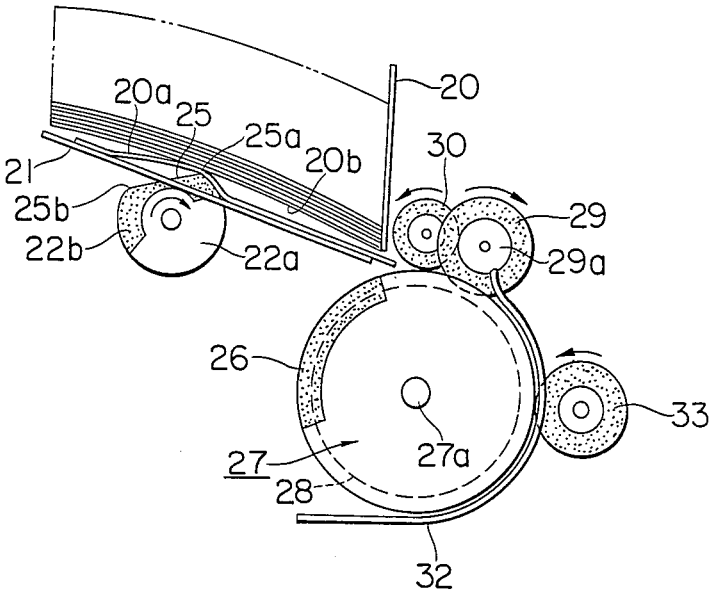
Figure 10:
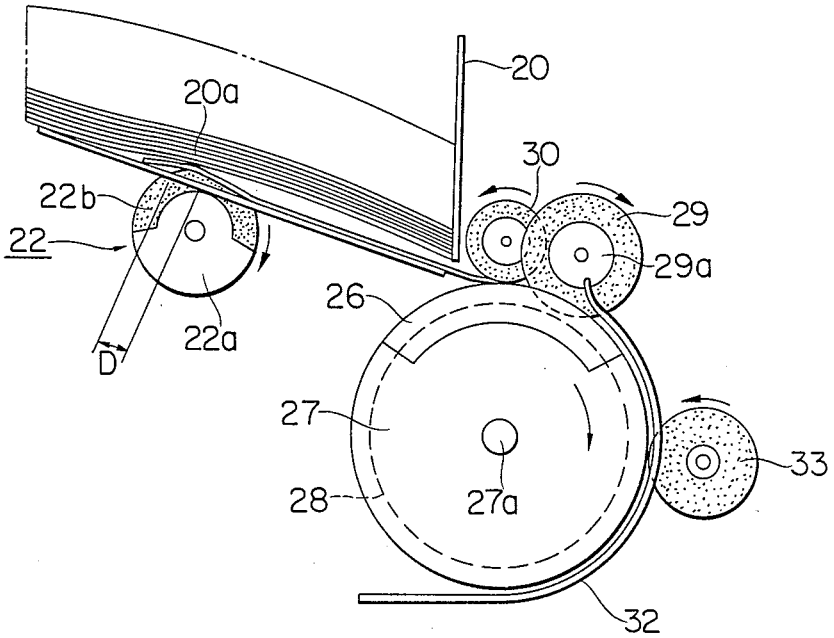
FIG. 10 is a side view showing an operative aspect of the apparatus for counting the number of paper sheets according to the present invention.

Thus, with the feed-out auxiliary rolls 22, a substantially flat central frictional surface is provided at the recessed zone 25, and the leading corner 25*a* of the roll 22, in the rotational direction of the roll, is rounded with a smaller radius, while the other or trailing corner 25*b* is rounded with a radius considerably larger than the radius of the corner 25*a*, and hence, is shaped in a manner different from the conventional roll shown in FIG. 1. Hence, when the feed-out auxiliary roll 22 is driven in rotation, the sheet 20*a* is raised in its entirety by the leading rounded corner 25*a* of the roll 22 as the sheet 20*a* is fed by contact with the frictional surface 22*b*, as shown in FIG. 7. When the feed-out auxiliary roll 22 has been rotated further to the state shown in FIG. 8, the sheet 20*a* descends into contact with the recessed zone 25 by its own gravity. As the roll 22 has been rotated further to the state shown in FIG. 9, the sheet 20*a* is contacted by the wider contact surface of the trailing corner 25*b* chamfered to a larger radius than that of the leading corner 25*a* and may thus be supplied positively towards the gap between the separating rolls 29 and the payout roll 27 by a force of friction proportionate to the area of the contact surface of the corner 25*b* with the paper sheet 20*a*. In this manner, in the state shown in FIG. 10, the roll may be contacted with the sheet at the trailing corner 25*b* by a contact width D wider than that attained with the conventional offset roll.

From the foregoing it should be appreciated that the present invention provides a paper sheet delivery apparatus in which a strong force of separation may be produced and the paper sheet may be vertically vibrated by reason of the recessed zone of the feed-out auxiliary roll. The leading rounded corner of the recessed, zone, having a smaller radius of curvature acts to raise and bend the paper sheet for advancing the leading edge of the sheet with a stronger force of friction due to the wide contact area, while the trailing rounded corner having a larger radius of curvature acts to allow the sheet to descend by its own gravity for positively advancing the trailing edge of the sheet with a stronger force of friction due to the widened contact area with the paper sheet. In this manner, the delivery device of the present invention provides for separating and feeding out the paper sheets in a reliable manner no matter whether the sheets are used-up sheets or new ones endowed with sufficient toughness, thus effectively obviating the deficiency of the prior-art apparatus. It should be noted that, although the description has been made hereinabove with reference to a feed-out auxiliary roll having a flat central portion of the recessed zone, as shown in FIG. 3, similar effects may naturally be derived from a roll having a somewhat concave central portion of the recessed zone as shown in FIG. 4.

What we claim is:

1. In apparatus for counting a number of paper sheets in which the sheets are stacked on a hopper and fed from the hopper to a payout roll adjacent the hopper by a feed-out, auxiliary roll mounted at a bottom of the hopper, said feed-out, auxiliary roll having a first peripheral surface portion and a second peripheral surface portion forming the remainder of the peripheral surface, said second peripheral surface portion having a coefficient of friction greater than a coefficient of friction of said first peripheral surface portion, characterized in that all points on said second surface portion are spaced from an axis of said feed-out, auxiliary roll by a distance not greater than a radius of said first surface portion and a sheet contacting, peripherally extending portion of said second surface portion, which is less in peripheral extent than the peripheral extent of said second surface portion, has all points thereof spaced from said axis by a distance which is less than the radius of said first surface portion.

2. Apparatus as claimed in claim 1 wherein an upstream end and downstream end of said peripherally extending portion of said second surface portion are rounded.

3. Apparatus as claimed in claim 2 wherein a radius of curvature of said upstream end is less than a radius of curvature of said downstream end.

4. Apparatus as claimed in claim 3 wherein an upstream end of said peripherally extending portion of said second surface portion is spaced from an upstream end of said second surface portion by a distance which is less than a spacing between the downstream end of said peripherally extending portion of said second surface portion from the downstream end of said second surface portion.

5. Apparatus as claimed in claim 1 wherein said peripherally extending portion of said second surface portion is substantially flat.

* * * * *